US005783538A

United States Patent [19]

Totoki

[11] Patent Number: 5,783,538

[45] Date of Patent: Jul. 21, 1998

[54] DETERGENT COMPOSITION

[75] Inventor: Takatoshi Totoki, Sagamihara, Japan

[73] Assignee: Minnesota Mining and Manufacturing Company, St. Paul, Minn.

[21] Appl. No.: 765,231

[22] PCT Filed: May 4, 1995

[86] PCT No.: PCT/US95/05102

§ 371 Date: Dec. 12, 1996

§ 102(e) Date: Dec. 12, 1996

[87] PCT Pub. No.: WO96/00769

PCT Pub. Date: Jan. 11, 1996

[30] Foreign Application Priority Data

Jun. 30, 1994 [JP] Japan ..... 6-149318

[51] Int. Cl.[6] ..... C11D 1/83; C11D 1/14; C11D 1/22; C11D 3/10

[52] U.S. Cl. ..... 510/197; 510/365; 510/501; 510/500; 510/495; 510/426; 510/435; 510/433

[58] Field of Search ..... 510/197, 365, 510/501, 500, 495, 426, 435, 433

[56] References Cited

U.S. PATENT DOCUMENTS

| | | | |
|---|---|---|---|
| 3,928,065 | 12/1975 | Savino | 134/7 |
| 5,080,831 | 1/1992 | VanEenam | 252/558 |
| 5,102,573 | 4/1992 | Han et al. | 252/153 |
| 5,158,710 | 10/1992 | VanEenam | 252/539 |
| 5,254,290 | 10/1993 | Blandiaux et al. | 252/545 |
| 5,279,760 | 1/1994 | Sato et al. | 252/174.22 |
| 5,454,985 | 10/1995 | Harbin | 252/558 |
| 5,470,508 | 11/1995 | Narayanan et al. | 252/542 |
| 5,531,818 | 7/1996 | Lin et al. | 106/23 |
| 5,688,753 | 11/1997 | Cala et al. | 510/175 |
| 5,712,236 | 1/1998 | Bolkan et al. | 510/259 |
| 5,714,448 | 2/1998 | Choy et al. | 510/181 |

FOREIGN PATENT DOCUMENTS

| | | |
|---|---|---|
| 0 103 466 | 3/1984 | European Pat. Off. . |
| 0 286 075 | 10/1988 | European Pat. Off. . |
| WO 93/16162 | 1/1993 | WIPO . |

*Primary Examiner*—Douglas J. McGinty
*Attorney, Agent, or Firm*—Daniel R. Pastirik

[57] ABSTRACT

A detergent composition comprising the following ingredients: an inorganic alkali salt, a water-insoluble organic solvent, an amine, a pyrrolidone compound, polyhydric alcohol, anionic surface active agent, and water.

6 Claims, 2 Drawing Sheets

DETERGENT COMPOSITION

TECHNICAL FIELD

The present invention pertains to a detergent composition including an inorganic alkali salt, water insoluble organic solvent, amine, pyrrolidone compound, anionic surface active agent, and water.

BACKGROUND ART

The conventional detergent composition for detergent the smears composed of oils is composed of widely known combination of a strong alkaline substance, such as sodium hydroxide, potassium hydroxide, sodium silicate or the like, with a surface active agent. Such a strong alkaline detergent composition raises safety problems. That is, in the case where a facility such as grill and oven (the facilities, devices and the like, the smears of which are required to be deterged will be hereinafter referred to as "object to be cleaned" as a generic name) is used at a high temperature and cleaned with such a detergent immediately after the use thereof (high temperature cleaning), such a detergent easily splatters to present a danger to the users in the vicinity. Another problem is that dispersion of a detergent into the application area, where it can be inhaled or settle on surfaces other than object to be cleaned, is noticeable while cleaning is carried out by spraying operation. Note, the terminology "dispersing" of the detergent, as used herein, includes a mist of the detergent generated during spraying thereof, a vapor. If cleaning is to be carried out after the temperature of an object to be cleaned has been lowered approximately to room temperature, the pause time extending from the stop of use to reuse becomes a considerably long period of time, thus making that time-consuming approach highly inconvenient. In addition, the conventional detergent composition contains a great amount of solids content, and there is a concern that it tends to leave residues adhered to an object cleaned at high temperature. These residues are essentially irremovable once baked onto the surface of the object cleaned, even by rinsing for an extended period of time.

On the other hand, another detergent composition useful for the cleaning of kitchen ranges, barbecue utensils, and the like is known from Japanese Examined Patent Publication No. 57-47238. This detergent composition is composed of water, an inorganic detergent, ammonia and/or organic amine compound, water soluble mono- or di-substituted amide, water insoluble or slightly soluble solvent, and a surface active agent, and can effectively clean and remove grease, fat and the like at a low temperature of 150° F. (about 65° C.), and owing to its non-alkalinity exposure, dangers to users can be avoided. However, since this detergent composition is poor in compatibility, variability is observed in the detergency thereof, and a phenomenon of producing white turbidity appears easily and phase separation is likely to be produced. Therefore, at the time of the practical use of this detergent composition, it is necessary to add thereto a much greater amount of thickener to produce a paste, and as a result thereof, it becomes difficult to coat this detergent composition by a hand spray, and it is necessary to resort to brushing by use of a brush or spraying it in an aerosol form. This brings about noticeable lowering of its workability. Further, this detergent composition has the problem that a great amount of residue remains on the surface of the cleaned object after completion of cleaning. The residue of this kind is difficult to remove by rinsing, requiring a long period of rinsing time, and as a result, a safety problem emerges due to the prolonged exposure to cleaning agents.

In addition, a detergent composition for detergent smears of grill, oven and the like also is known from, e.g., Japanese Examined Patent Publication No. 4-61915. This detergent composition is used for quickly deterging the carbonized oily smears of a grill, oven, and the like, and grease and the like accumulated within a duct, and contains, as indispensable constituent ingredients, alkali metal hydroxide, triethanolamine, polyhydric alcohol, ampholytic surface active agent, and water. This detergent composition is composed essentially of a relatively strong alkali, and therefore raises a safety problem for users. In addition, in the explanation of this detergent composition, there is mentioned the "dispersing" of a detergent at the time of high-temperature cleaning as the problem awaiting solution of the conventional technique, but this detergent composition is still thought insufficient as a means of solving such problem. That is, this detergent composition is likely to be splattered especially at a high temperature or at the time of a spraying application, so as to exert danger to the users, or water droplets generated on the highly heated plate, and the like phenomena. In addition, the major proportion of the indispensable constituent ingredients is composed of solid contents, and this detergent composition has the problem in that the detergent composition will remain as residue on cleaned objects.

The purpose of the present invention is therefore to solve the problems of the aforesaid conventional detergent compositions.

DISCLOSURE OF INVENTION

The present invention relates to a detergent composition that is safe to the health of users, including at usages involving high temperature and/or spray applications. Further, the present detergent composition does not remain at all as residue, or remains only as a trace of residue, on an object once cleaned therewith, which enables uniform cleaning in a relatively short time and with high efficiency, and which inventive detergent composition is suitable especially for removing the oil and grease smears on a grill, oven or the like.

One purpose of the present invention is to enhance the safety of the composition and thereby lessen the possible ill effect to users even when the detergent composition is applied to an object to be cleaned at a high temperature or by spray coating.

Another purpose of the present invention is to make it possible to effect efficient cleaning with safety and in a short time at a high temperature, e.g., at a temperature ranging from 50° to 150° C.

Yet another purpose of the present invention is to set the viscosity of the composition to a predetermined value, and thereby prevent the production of sags and the like in the detergent film for an object to be cleaned, and simultaneously to make the use of a means such as spray coating possible, and thereby noticeably improve the workability and detergency.

An additional purpose of the present invention is to prevent the formation and leaving of detergent residue on the object cleaned by the inventive detergent composition, other than trace amounts at the most which would pose no health threat.

Yet another purpose of the present invention is to make the composition of the detergent composition uniform, and thereby enable uniform cleaning.

These and other purposes of the present invention will be easily understood from the following described detergent composition of the present invention.

The aforesaid purposes of the present invention can be achieved, according to the present invention, by a detergent composition comprising the following ingredients:

an inorganic alkali salt, a water-insoluble organic solvent, an amine, a pyrrolidone compound, polyhydric alcohol, anionic surface active agent, and water.

The detergent composition according to the present invention contains, in a preferred embodiment, 1 to 50 parts by weight of said inorganic alkali salt, 1 to 50 parts by weight of said water-insoluble organic solvent, 0.1 to 30 parts by weight of amines, 0.1 to 30 parts by weight of said pyrrolidone compound, I to 200 parts by weight of said polyhydric alcohol, and 0.1 to 50 parts by weight of said anionic surface active agent (based on 100 parts by weight of water).

Note, the term "water-insoluble" used herein means that the extent to which a substrate (solute) mixes with pure water at a room temperature and an atmospheric pressure is 20% or less.

The above-mentioned ingredients to be contained in the detergent composition according to the present invention are more specifically described later herein.

In another preferred embodiment, the inorganic alkali salt of the inventive detergent composition is an inorganic alkali carbonate. It also is preferred that the water-soluble organic solvent is selected from the group consisting benzyl alcohol, phenyl glycol ether, and phenyl carbitol. It is preferred that the amine is selected from the group consisting of aliphatic primary amines and aromatic primary amines. It also is preferred that the pyrrolidone compound is water-soluble. Also, it is preferred that the anionic surface active agent is selected from the group consisting of alkylbenzenesulfonates and alkylsulfonates. Preferably, the inventive detergent composition has a Brookfield viscosity at 20° C. within the range of 5 to 50,000 cps.

According to the present invention, since the detergent composition does not contain a strong alkaline substance, unlike the conventional detergent composition, workers can handle it with safety. In addition, the present detergent composition is advantageous in the point that it can be applied to an object to be cleaned at the time of high temperature or by spray coating. In addition, in the above connection, since, after application of the present detergent composition, the subsequent washing can be conducted without waiting for the lowering of the temperature of an object to be cleaned, i.e., immediately after the application of the detergent composition, the washing time can be shortened to a great extent.

Since the detergent composition of the present invention has a suitable viscosity, there can be prevented the production of sags in the detergent film on an object to be cleaned, and the like, and a means such as spray coating can be used with safety and in a straight forward way, whereby the handleability can be noticeably improved.

In addition, since the detergent composition of the present invention is excellent in detergency; washing in a short time and with high efficiency becomes attainable due to this reason.

In addition, when the detergent composition of the present invention is used, there remains little residue of the composition on an object to be cleaned, after the completion of cleaning, rinsing can be effected simply and in a short time, and after the completion of rinsing, no residue is present, or even if a residue is present, it is only in a very slight trace amount, and therefore, for example, when the object to be cleaned is a grill or oven, there can be avoided the adverse effect on the food subsequently cooked on the cleaned object.

Since the detergent composition of the present invention has good compatibility with customary cooking or baking surfaces, an object to be cleaned can be uniformly cleaned without unevenness.

The detergent composition according to the present invention exhibits its excellent effect when it is used for removing the stubborn smears on a grill, oven and the like. Especially when the present detergent composition is used for a steam oven which can be rinsed with water, its deterging effect is noticeable within a wide temperature range between about 50° and 150° C., and the present detergent composition is also excellent in terms of safety.

BEST MODE FOR CARRYING OUT THE INVENTION

Figure 1:
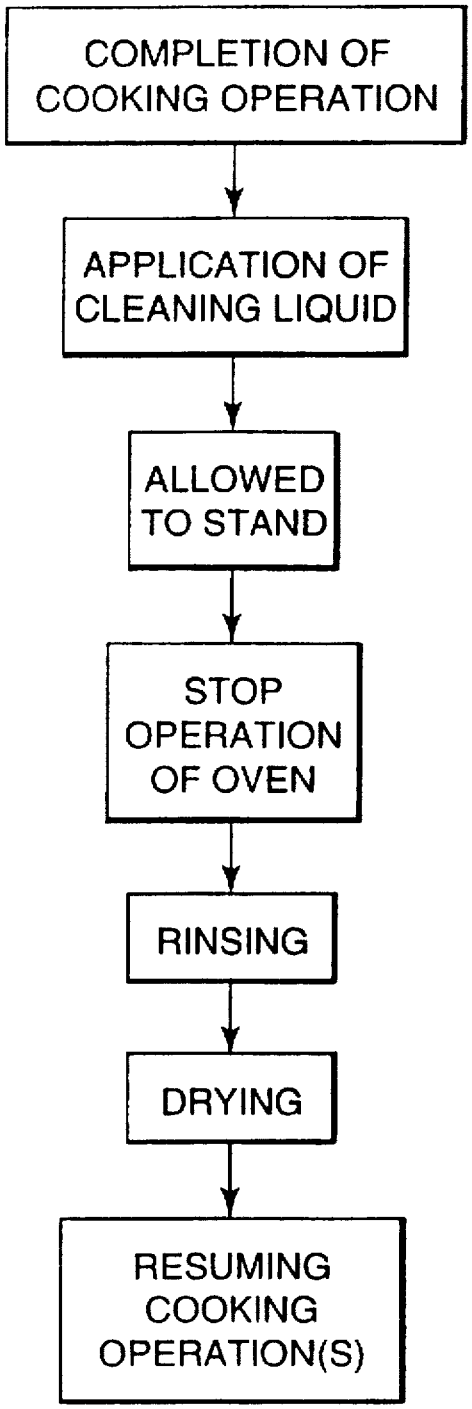
FIG. 1 is a flow sheet illustrating in a series and succession of steps showing a preferred method for cleaning the oily smears of a steam oven by use of the detergent composition of the present invention.

The present invention relates to a detergent or cleaner composition, and more specifically, a detergent composition suitable for deterging the smears on a grill, oven, and the like, especially those used for food preparation. The detergent composition according to the present invention exhibits excellent detergency and simultaneously brings about noticeable improvement of safety and workability, especially when it is used for the detergent of a steam oven. The smears herein referred to be deterged by the detergent composition of the present invention are principally those such as modified proteins and fats and oils adhered to the object to be cleaned, especially baked-on smears caused by dispersing, dripping and condensing of fats and oils from cooked food, which are difficult to be removed by an ordinary cleaning method. In addition, in the present specification, such smears will sometimes be referred to merely as "oil" or "oils".

The first ingredient of the detergent composition of the present invention is an inorganic alkali salt. The inorganic alkali salt is used for the purpose of decomposing oils and thereby achieving detergency. Such a salt includes carbonates, phosphates, borates and the like, each having its own peculiar advantage. For example, carbonates include sodium carbonate, potassium carbonate, ammonium carbonate, and the like, and have advantages such as high safety, comparatively high detergency, easy availability due to low prices, rare public pollution due to the absence of a phosphorus compound, and the like. Phosphates include trisodium phosphate, tripotassium phosphate, trilithium phosphate, sodium metapoylphosphate and the like and have the advantages, such as high detergency. Borates include sodium borate, potassium borate, ammonium borate, and the like, and have the advantages, such as especially high safety.

The inorganic alkali salt is used, as described in the foregoing, in a proportional amount ranging from 1 to 50 parts by weight based on 100 parts by weight of water in the composition. When the proportional amount of the inorganic alkali salt is less than 1 part by weight, the cleaning effect sought from the addition of the inorganic alkali salt cannot be adequately exhibited, and, on the other hand, when it exceeds 50 parts by weight, further improvement of the cleaning effect is not observed, and the compatibility of the overall composition will be lowered. The inorganic alkali salt is used in a proportional amount ranging preferably from 3 to 30 parts by weight, and especially preferably from 5 to 20 parts by weight, based on 100 parts by weight of water, in order to obtain good balance with the other ingredients.

The second ingredient is a water-insoluble organic solvent. The water-insoluble organic solvent has a function of dissolving oils and thereby enhancing the detergency of the detergent composition. In particular, since this organic solvent is "water-insoluble", it improves the affinity of the composition with oils to be cleaved from an object, and is effective in the point that the boiling point is comparatively high, and this organic solvent is unlikely to be scattered even at the time of high-temperature cleaning. Such an organic solvent includes, for example, diphenyl ether, 2-ethyl-1-hexanol, 2-ethylhexane-1,3-diol, benzyl alcohol, phenyl glycol ether, phenyl carbitol, 2-octanol, n-octanol, decanol, dodecanol, and the like. These organic solvents may be used each singly or as an optional mixture of 2 or more of them. Amongst these, benzyl alcohol, phenyl glycol ether, and phenyl carbitol exhibit high detergency and good affinity with the combinedly used polyhydric alcohol, resulting in good compatibility, and owing to these high boiling points, they are not dispersed even at the time of high-temperature cleaning, so that these compounds can be advantageously used.

The water-insoluble organic solvent is used in a proportional amount ranging from 1 to 50 parts by weight based on 100 parts by weight of water in the composition. When this proportional amount is less than 1 part by weight, the effect as an organic solvent cannot be exhibited, and, on the other hand, when it exceeds 50 parts by weight, any further improvement of the detergency is not observed, and there is a concern that if amount of water-insoluble ingredients are increased too much phase separation will occur. Such an organic solvent is used in a proportional amount ranging preferably from 3 to 30 parts by weight, and especially preferably from 5 to 20 parts by weight, based on 100 parts by weight of water, in order to obtain good balance with the other ingredients.

The third ingredient is an amine. Amines dissolve oils, and by addition of a small amount thereof, the detergency of the detergent composition is improved. As suitable amines, examples include aliphatic or aromatic primary amines, which have hitherto been used in general as a defatting agent, typically, e.g., monoethanolamine, diethanolamine, propanolamine, ethylamine, benzylamine, butylisopropanolamine, N-(β-aminoethyl) ethanolamine, and the like. These amines will function as solvents capable of dissolving principally saturated and unsaturated fatty acids. These amines can be used alone or in combination with each other.

Amines are used in a proportional amount ranging from 0.1 to 30 parts by weight based on 100 parts by weight of water in the composition. When this proportional amount is less than 0.1 part by weight, the effect as a defatting agent cannot be exhibited, and, on the other hand, when it exceeds 30 parts by weight, the component can adversely affect the users. Amines are used in a proportional amount ranging preferably from 5 to 20 parts by weight, and especially preferably from 0.2 to 10 parts by weight, based on 100 parts by weight of water, in order to obtain good balance with the other ingredients. In any event, amines are required to be used owing to the strong detergency contributed thereby, but in order to avoid the problems such as skin rash of the users produced when they are used in a great amount, it is recommended to limit the use thereof to the least possible amount.

The fourth ingredient is a pyrrolidone compound. The pyrrolidone compound has a function as "a solvent" capable of dissolving saturated and unsaturated fatty acids and a function as "surface active agent" improving the wetting property of the detergent. As suitable pyrrolidone compounds, examples include N-methylpyrrolidone, N-ethylpyrrolidone, N-methylhydroxypyrrolidone, N-ethylhydroxypyrrolidone, N-cyclohexyprrolidone, N-octylpyrrolidone, N-dodecylpyrrolidone, and the like. In addition, amongst these pyrrolidones, preferred are the ones where the alkyl group contained therein is a straight chain or branched alkyl group (with 7 or more carbon atoms), which are water-insoluble, e.g., N-octylpyrrolidone, N-dodecylpyrrolidone, and the like. When the pyrrolidone compound is water-insoluble as mentioned above, there is produced a noticeable effect of improving the wetting property to an object to be cleaned.

The pyrrolidone compound is used in a proportional amount ranging from 0.1 to 30 parts by weight based on 100 parts by weight of water in the composition. When the proportional amount is less than 0.1 part by weight, the effect due to the addition of the pyrrolidone compound is not exhibited, and, on the other hand, when it exceeds 30 parts by weight, phase separation is caused and a uniform composition cannot be obtained. The pyrrolidone compound is used in a proportional amount ranging preferably from 0.5 to 20 parts by weight, and especially preferably from I and 10 parts by weight, based on 100 parts by weight of water, in order to obtain good balance with the other ingredients.

The fifth ingredient is polyhydric alcohol. The polyhydric alcohol has a function as "a solubilizing agent" for an organic solvent; a function as "a dry-up-preventing agent" of the detergent at the time of high-temperature cleaning; and a function as "a solvent" in the case of fatty acids being removed. As the polyhydric alcohol which is advantageously usable in the present invention, there are mentioned propylene glycol and glycerine because of the low toxicity and substantial harmlessness thereof Propylene glycol is greatly effective for solubilizing an organic solvent, and glycerine is excellent in compatibility with phenyl glycol ether or phenyl carbitol, which is used as an organic solvent.

The polyhydric alcohol is used in a proportional amount ranging from 1 to 200 parts by weight based on 100 parts by weight of water in the composition. When the proportional amount is less than 1 part by weight, the effect due to the addition of the polyhydric alcohol cannot be exhibited, and on the other hand, when it exceeds 200 parts by weight, not only the cost is increased, but also the deterging effect becomes lowered. The polyhydric alcohol is used in a proportional amount ranging preferably from 10 to 150 parts by weight, and especially preferably from 20 to 100 parts by weight, based on 100 parts by weight of water, in order to obtain good balance with the other ingredients.

The sixth ingredient is an anionic surface active agent, which has not only the inherent function as "surface active agent" of improving the wetting property with an object to be cleaned and improving the detergency, but also a function as "solubilizing agent" for solubilizing the combinedly used pyrrolidone compound. As the anionic surface active agent which can be advantageously used in the present invention, there are mentioned sulfates, e.g., sodium dodecylsulfate, higher alcohol sulfate, higher alcohol ethoxysulfate, and the like, alkylbenzenesulfonates, e.g., sodium dodecylbenzenesulfonate, and the like, and alkylsulfonates, e.g., sodium dodecylsulfonate, and the like. Especially advantageously usable surface active agents are alkylbenzenesulfonates and alkylsulfonates, from the viewpoint of easy availability and low costs.

The anionic surface active agent is used in a proportional amount ranging from 0.1 to 50 parts by weight based on 100 parts by weight of water in the composition. When the proportional amount is less than 0.1 part by weight, the effect due to the addition of the anionic surface active agent cannot be exhibited, and, on the other hand, when it exceeds 50 parts by weight, advantageous effect is not produced with regard to the deterging effect, though the cost is increased. The anionic surface active agent is used in a proportional amount ranging preferably from 0.5 to 30 parts by weight, and especially preferably from 1 to 20 parts by weight, based on 100 parts by weight of water, in order to obtain good balance with the other ingredients.

In addition, besides the above-mentioned six kinds of ingredients, there may be combinedly used therewith such other additives and adjuvants as are ordinarily used in the technical field of detergent compositions. As suitable supplemental and optional additives, there are mentioned, e.g., thickeners, abrasives, colorants, perfumes, and the like.

The detergent composition of the present invention has a Brookfield viscosity ranging preferably from 5 to 50,000 centipoise (cps) when measured at a temperature of 20° C. The Brookfield viscosity is determined at 20° C. and spindle rate of 60 r.p.m. on a Brookfield type viscometer with No. 3 rotor. When the viscosity is below 5 cps, there is brought about a problem concerning adhesion (sags) of the detergent to an object to be cleaned or a problem concerning sagging deterging effect, which is not preferable, and, on the other hand, when the viscosity exceeds 50,000 cps, there are brought about troubles such as difficulty of spray coating. The viscosity of the detergent composition is within a range more preferably between 10 and 10,000 cps, and especially preferably between 50 and 1,000 cps.

In order to impart the aforesaid adequate viscosity to the detergent composition, there can be added a thickener for adjustment of viscosity. As suitable thickener, there may be used, e.g., natural polysaccharides, inorganic fine particulates and the like, specifically xanthane gum, carrageenan, sodium alginate, carboxymethylcellulose salts or silica, alumina, and the like. In particular, xanthane gum, carrageenan and sodium alginate are the most suitable in the practice of the present invention, because they have a good solubility in water, a small amount thereof is sufficient to obtain a remarkable thickening effect, and they show a high level of safety due to no residue thereof after cleaning.

The detergent composition of the present invention has a pH value of 13 or less. The preferable pH value range is generally 10 to 13 in view of safety and cleaning power, though it somewhat varies depending on the compounding ratio of the ingredients constituting the composition.

The detergent composition of the present invention can be prepared by compounding the aforesaid ingredients according to any conventional manner. Although the order of the compounding of the ingredients can be widely changed depending upon the kinds of the ingredients and the amounts of the used ingredients, and the like, according to the present inventor's knowledge, compounding carried out in the following five stages, preferably at room temperature (about 25° C.), is advantageous in view of the uniformity of the composition and of the prevention of bubbling.

| | |
|---|---|
| The first stage: | to agitate the inorganic alkali salt and amines together with water |
| The second stage: | to admix and agitate the polyhydric alcohol |
| The third stage: | to admix and agitate the water-insoluble organic solvent |
| The fourth stage: | to admix and agitate the anionic surface active agent |
| The fifth stage: | to admix and agitate the pyrrolidone compound. |

When the detergent composition of the present invention is used, as already explained in detail, an object to be cleaned such as grill and oven can be cleaned in a relatively very short time and with high efficiency as compared with the conventional cleaning method, and the workability is also good. This will be explained with reference to the flow sheet for the cleaning method of the present invention.

FIG. 1 is a flow sheet explaining in succession a preferable method for cleaning oily smears of a steam oven by use of the detergent composition (cleaning liquid) of the present invention. A steam oven is ordinarily at a high temperature ranging from 80° to 100° C. immediately after the completion of the previous cooking operation. Leaving the oven operation at that temperature, the cleaning liquid is applied to the inside of the oven over those areas to be cleaned. In order to apply the cleaning liquid, a hand spray can be advantageously used, because the cleaning liquid of the present invention has a high level of safety. After the cleaning liquid has been applied to the oven, the oven is closed and allowed to stand for a period of time ranging from about 10 to 15 minutes. During this period of time, the cleaning liquid penetrates into the smears of the oven, so that cleaning action proceeds. After the oven has been allowed to stand for a predetermined period of time, the operation of the oven is discontinued, whereafter the oven is again opened and the smears remaining after the cleaning are rinsed away. Water is used for the rinsing. By the rinsing, not only the smears but also the cleaning liquid are washed out, leaving little or no residue. At the time when the inside of the oven is dried, the oven can be used again for cooking operations. In addition to rinsing with water, it is contemplated that wiping with a cloth or sponge is helpful in removing the treated smears.

Figure 2:
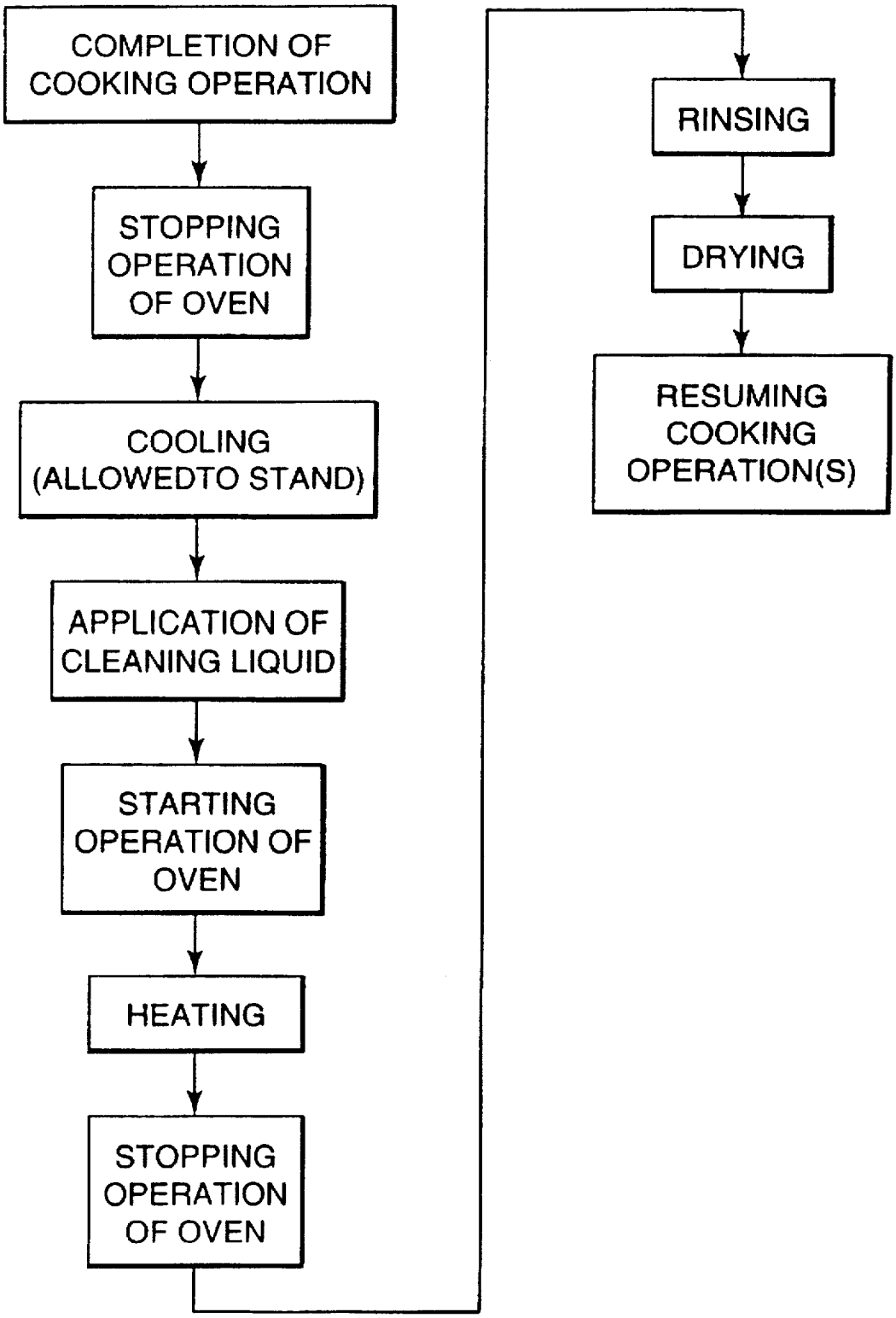
FIG. 2 is a flow sheet illustrating in a series and succession of steps showing the conventional cleaning method using a strong alkali.

For reference's sake, the conventional cleaning method using strong alkali cleaning liquid is shown in FIG. 2. According to the conventional cleaning liquid, if the used cleaning liquid scatters, the users may be endangered, and the temperature of the oven is lowered. That is, after the completion of the previous cooking operation, the operation of the oven is discontinued and the oven is allowed to stand as it is for a time adequate to cool the inside of the oven to approximately room temperature. As can be imagined, this operation requires a considerably long period of time, which results in the loss of the oven function for a long period of time. After cooling (i.e., by allowing the oven to stand), the cleaning liquid is applied to the oven smears. In this case, it is possible to use a hand spray in order to apply the cleaning liquid, as in the cleaning method of the present invention, but since the main ingredient of the conventional cleaning liquid typically is water containing a strong alkali ingredient, the problems such as the production of an airborne mist of the cleaning agent and the inhalation of the mist by the users cannot be avoided. After the cleaning liquid has been applied, it is necessary to allow the oven to stand for a period of time ranging from about 10 to 15 minutes as in the cleaning method in the present invention.

In addition, in order to achieve a cleaning effect, it is necessary to start the operation of the oven and heat the inside of the oven to a temperature of about 80° for a period of time ranging from about 10 to 15 minutes. After the oven has been heated for such a predetermined period of time, the operation of the oven is discontinued, and the oven is again opened, whereafter the inside of the oven is rinsed with water.

The detergent composition according to the present invention contains, as indispensable ingredients, an inorganic alkali salt having a function of decomposing oils and thereby developing detergency; a water-insoluble organic solvent having a function of dissolving oils and thereby improving detergency; an amine having a function of dissolving oils and thereby improving the detergency by addition of a small amount of the amine; a pyrrolidone compound having a function of dissolving oils, improving the wetting property of an object to be cleaned, and improving the detergency; a polyhydric alcohol having a function of adjusting the viscosity and evaporation rate of water, and simultaneously solubilizing the combinedly used non-water-soluble organic solvent; nonionic surface active agent having a function of solubilizing the combinedly used pyrrolidone compound, and so forth; and water, in combination, and therefore, since the excellent functions of these ingredients are synergetically exhibited, it becomes possible to perform uniform cleaning which ensures safety, which can be applied at the time of high-temperature or spray operation, which leaves no residue at all or very little after cleaning, and which can be performed in a short time and with high efficiency.

In the following examples, the present invention will be explained with reference to working examples and comparative examples. The "parts" described in the following are to be construed to indicate "parts by weight" unless otherwise specified.

EXAMPLES 1 to 6

In each of Examples, there were prepared cleaning liquids having the compositions as described in the following Table 1.

Preparation of Cleaning Liquid

In a beaker (300 ml), the thickener was dissolved in water and agitated at room temperature (about 25° C.) and for about 5 minutes on a propeller mixer rotating at 1000 r.p.m. To the resultant uniform solution, the remaining ingredients (see, Table 1) were admixed and agitated at room temperature and for about 3 minutes on a propeller mixer rotating at 300 r.p.m. A cleaning liquid having the intended composition was thus obtained.

TABLE 1

(Composition of Cleaning Liquid)

| Ingredients | Examples 1 | 2 | 3 | 4 | 5 | 6 |
|---|---|---|---|---|---|---|
| potassium carbonate | 5 | 10 | 15 | 20 | — | — |
| ammonium carbonate | — | — | — | — | 10 | 15 |
| benzyl alcohol | 5 | 10 | 15 | 20 | — | — |
| phenylmethyl carbitol | — | — | — | — | 8 | 15 |
| monoethanolamine | 2 | 5 | 10 | 15 | — | — |
| diethanolamine | — | — | — | — | 5 | 10 |

TABLE 1-continued (Composition of Cleaning Liquid)

| Ingredients | Examples 1 | 2 | 3 | 4 | 5 | 6 |
|---|---|---|---|---|---|---|
| N-octylpyrrolidone | 0.5 | 2 | 3 | 5 | 1 | — |
| N-dodecylpyrrolidone | — | — | — | — | — | 3 |
| glycerin | 20 | — | — | — | 60 | — |
| polypropylene glycol | — | 60 | 80 | 120 | — | 100 |
| sodium dodecylbenzenesulfonate | 2 | 3 | 5 | 10 | 2 | 5 |
| sodium dodecylsulfonate | — | — | — | — | | — |
| xanthene gum | 0.5 | 0.5 | 0.5 | 0.5 | 0.5 | 0.5 |
| water | 100 | 100 | 100 | 100 | 100 | 100 |

(The numerals in the table are parts by weight)

When the performances of the obtained cleaning liquids were evaluated as for the items of compatibility, detergency, rinsability and viscosity, there were obtained the results as set forth in Table 2.

TABLE 2

(Performances of Cleaning Liquid)

| Evaluation Items | Examples 1 | 2 | 3 | 4 | 5 | 6 |
|---|---|---|---|---|---|---|
| Compatibility | good | good | good | good | good | good |
| Detergency | good | excellent | excellent | excellent | good | good |
| Rinsability | good | good | good | good | good | good |
| Viscosity | excellent | excellent | excellent | excellent | excellent | excellent |

As can be understood from the results of Table 2, in the case of the cleaning liquids according to the present invention, there can be obtained well-balanced excellent performances with regard to all the items of compatibility, detergency, rinsability, and viscosity.

The evaluation method and evaluation criterion used in the present working example are, respectively, as described below.

Evaluation of Compatibility:

The condition of the obtained cleaning liquid was visually observed, and evaluated in the following two grades.

| | |
|---|---|
| "good": | transparent and uniform solution (capable of application by a hand spray, rinsable with water) |
| "bad": | accompanied with white turbidity or phase separation |

Evaluation of Detergency:

A 0.5 g of mixture of pig tallow (lard commercially available from Tsukishima Food Co.) and vegetable fat and oil (salad oil commercially available from Nisshin Oil Co.) was coated with a brush on an iron plate having a size of 25 mm×75 mm×0.8 mm. The oily film having a thickness of about 0.5 mm was coated on an approximately two-thirds portion of the surface of the iron plate. The oily iron plate was introduced into an oven so as to be baked for 2 hours at 250° C. Subsequently, drops (about 0.4 ml) of sample cleaning liquid were dropped onto the iron plate baked with fat and oil, and the iron plate was introduced into a constant temperature and constant humidity oven with 80° C.—90% RH, and maintained for 30 minutes. The iron plate was taken out from the oven and the smears of the adhered fat and oil were washed with water by rubbing water-moistured soft sponge against the treated smear. Rubbing was made with application of a uniform and constant amount of pressure. The removal rate (%) showing to what extent the fat and oil had been removed was visually judged.

| | |
|---|---|
| "Excellent": | removal rate of 80% or more |
| "good": | removal rate ranging from 50 to 80% |
| "bad": | removal rate less than 50% |

Evaluation of Rinsability:

The aforesaid procedure for the evaluation of detergency was repeated except the washing and rubbing procedures were replaced by the following procedure. After the treated iron plate had been taken out from the oven, city tap water (Kanagawa) was allowed to vertically flow over the cleaning liquid (incorporating the smears of fat and oil) of the iron plate, declined at an angle of about 45° and distanced at about 15 cm from a faucet, for a period of time of 30 seconds. The pressure of the tap water was 0.1 to 0.4 kgf/cm$^2$. Visual observation was made as to whether the cleaning liquid remained or not.

| | |
|---|---|
| "good": | no residue (The cleaning liquid was completely removed by rinsing.) |
| "bad": | The cleaning liquid remained on the plate as a visually discernible residue. |

Evaluation of Viscosity:

The Brookfield viscosities of the cleaning liquids were determined at a temperature of 20° C. as previously mentioned, and evaluated in the following 4 grades.

| | |
|---|---|
| "excellent": | 50 to 1000 cps |
| "good": | 10 to below 50 cps, above 1000 to 10000 cps |
| "tolerably good": | 5 to below 10 cps, above 1000 to 50000 cps |
| "bad": | below 5 cps, above 50000 |

Comparative Examples 1 to 4

The procedure described in Examples 1 to 6 was repeated. In the present comparative examples, however, the cleaning liquids having the compositions as described in the following Table 3 were prepared for the comparison's sake.

TABLE 3

(Composition of Cleaning Liquids)

| | Comparative Examples | | | |
|---|---|---|---|---|
| Ingredients | 1 | 2 | 3 | 4 |
| potassium carbonate | 0.1 | 5 | 60 | 10 |
| ammonium carbonate | — | — | — | — |
| benzyl alcohol | 2 | 2 | 40 | 10 |
| phenylmethyl carbitol | — | — | — | — |
| monoethanolamine | 1 | 1 | 25 | 5 |
| diethanolamine | — | — | — | — |
| N-octylpyrrolidone | 0.2 | — | 20 | 10 |
| N-dodecylpyrrolidone | — | — | — | — |

TABLE 3-continued (Composition of Cleaning Liquids)

| | Comparative Examples | | | |
|---|---|---|---|---|
| Ingredients | 1 | 2 | 3 | 4 |
| glycerine | — | — | 250 | — |
| polypropylene glycol | 10 | 20 | — | — |
| sodium dodecylbenzenesulfonate | 0.01 | 0.1 | 1 | 2 |
| sodium dodecylsulfonate | — | — | — | — |
| water | 100 | 100 | 100 | 100* |

(The numerals in the table are parts by weight)
100*: containing 100 parts by weight of magnesium aluminium silicate When the obtained cleaning liquids were evaluated as to the items of compatibility, detergency, rinsability, and viscosity, there were obtained the results as described in Table 4.

TABLE 4

(Performances of Cleaning Liquids)

| | Comparative Examples | | | |
|---|---|---|---|---|
| Evaluation Items | 1 | 2 | 3 | 4 |
| Compatibility | bad | good | bad | bad |
| Detergency | bad | bad | good | good |
| Rinsability | good | good | bad | bad |
| Viscosity | excellent | excellent | excellent | bad |

As can be understood from the results of Table 4, in the case of the cleaning liquids having the compositions departing from the range of the present invention, although acceptable results can be obtained in some but not all of the compatibility, detergency, rinsability, and viscosity, the balance of properties are not uniformly improved.

I claim:

1. A detergent composition formulated with a combination of ingredients, based on 100 parts by weight of water, comprising:

1 to 50 parts by weight of an inorganic alkali salt, 1 to 50 parts by weight of a water-insoluble organic solvent, 0.1 to 30 parts by weight of an amine, 0.1 to 30 parts by weight of a water insoluble pyrrolidone compound, 1 to 200 parts by weight of polyhydric alcohol, and 0.1 to 50 parts by weight of anionic surface active agent.

2. A detergent composition as claimed in claim 1, wherein said anionic surface active agent is selected from the group consisting of alkylbenzenesulfonates and alkylsulfonates.

3. A detergent composition as claimed in claim 1, wherein said inorganic alkali salt is an inorganic alkali carbonate.

4. A detergent composition as claimed in claim 1, wherein said water-insoluble organic solvent is selected from the group consisting of benzyl alcohol, phenyl ether, and phenyl carbitol.

5. A detergent composition as claimed in claim 1, wherein said amine is selected from the group consisting of aliphatic primary amines and aromatic primary amines.

6. A detergent composition as claimed in claim 1, wherein the Brookfield viscosity at 20° C. of said composition is within the range between 5 and 50,000 cps.

* * * * *